US009719470B2

(12) United States Patent
Brewer

(10) Patent No.: US 9,719,470 B2
(45) Date of Patent: Aug. 1, 2017

(54) INLET MANIFOLD WITH WATER-TRANSPORTING STRAWS

(71) Applicant: FORD GLOBAL TECHNOLOGIES, LLC, Dearborn, MI (US)

(72) Inventor: Katherine Jane Brewer, Belleville, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 47 days.

(21) Appl. No.: 14/707,017

(22) Filed: May 8, 2015

(65) Prior Publication Data

US 2016/0326995 A1 Nov. 10, 2016

(51) Int. Cl.
*F02M 35/104* (2006.01)
*F02M 35/08* (2006.01)

(52) U.S. Cl.
CPC ..... *F02M 35/104* (2013.01); *F02M 35/088* (2013.01)

(58) Field of Classification Search
CPC ..... F02M 35/10072; F02M 35/10052; F02M 35/10045; F02M 35/161
See application file for complete search history.

(56) References Cited

U.S. PATENT DOCUMENTS

| | | | | |
|---|---|---|---|---|
| 5,168,838 | A * | 12/1992 | Seike | F02B 27/02 123/184.31 |
| 5,924,399 | A | 7/1999 | Koike et al. | |
| 6,149,478 | A * | 11/2000 | Lehmann | B63J 3/02 440/88 R |
| 6,860,771 | B2 * | 3/2005 | Mashiko | B63J 2/06 440/88 A |
| 8,151,775 | B2 * | 4/2012 | Kim | F01M 13/022 123/41.86 |
| 8,459,224 | B2 * | 6/2013 | Harada | F02M 29/00 123/184.47 |
| 2009/0260906 | A1 | 10/2009 | Hartland et al. | |
| 2010/0089355 | A1 * | 4/2010 | Fredrickson | B60K 28/00 123/184.48 |
| 2014/0034006 | A1 * | 2/2014 | Senda | F02M 35/104 123/184.53 |
| 2014/0158096 | A1 | 6/2014 | Leone et al. | |
| 2014/0165948 | A1 | 6/2014 | Sekiguchi et al. | |

* cited by examiner

*Primary Examiner* — Stephen K Cronin
*Assistant Examiner* — Long T Tran
(74) *Attorney, Agent, or Firm* — LeClairRyan

(57) ABSTRACT

An inlet manifold includes a plenum having a plenum floor and a plenum cover positioned next to the plenum floor, and at least one straw supported on and extending from the plenum floor toward the plenum cover to transport water.

3 Claims, 4 Drawing Sheets

INLET MANIFOLD WITH WATER-TRANSPORTING STRAWS

TECHNICAL FIELD

The present invention in one or more embodiments relates to an inlet manifold with one or more water-transporting straws.

BACKGROUND

In internal combustion engines, intake manifolds may be attached to cylinders for providing air or an air/fuel mixture. A throttle body may be connected to the intake manifold to deliver pressure and flow control at the inlet manifold. Airflow is transported from the throttle body into the plenum chamber and then to the cylinder via a number of flow runners.

By way of example, U.S. Patent Application Publication US 2009/0260906 A1 discloses an air intake manifold positioned in close proximity to an air inlet and runners.

SUMMARY

In one or more embodiments, an inlet manifold includes a plenum including a plenum floor and a plenum cover positioned next to the plenum floor, and at least one straw supported on and extending from the plenum floor toward the plenum cover to transport water, where the at least one straw may further include a first aperture to output water, the first aperture being positioned closer to the plenum cover than the plenum floor, and where the at least one straw may further include a second aperture to intake water, the second aperture being positioned closer to the plenum floor than to the plenum cover.

The cross-section of the at least one straw may include a wall enclosing therein a void space.

The at least one straw may be spaced apart from the plenum cover.

The plenum floor may include a cavity, the at least one straw being positioned at and contacting the cavity.

The at least one straw may be integral to the plenum floor.

The at least one straw may include a first portion and a second portion along a longitudinal direction, the second portion differing in cross-section area than the first portion.

The at least one straw may include first and second straws spaced apart from each other, the first straw differing than the second straw in at least one of cross-sectional area and extending length.

One or more advantageous features as described herein will be readily apparent from the following detailed description of one or more embodiments when taken in connection with the accompanying drawings.

BRIEF DESCRIPTION OF THE DRAWINGS

For a more complete understanding of one or more embodiments of the present invention, reference is now made to the one or more embodiments illustrated in greater detail in the accompanying drawings and described below wherein.

DETAILED DESCRIPTION OF ONE OR MORE EMBODIMENTS

Figure 1:
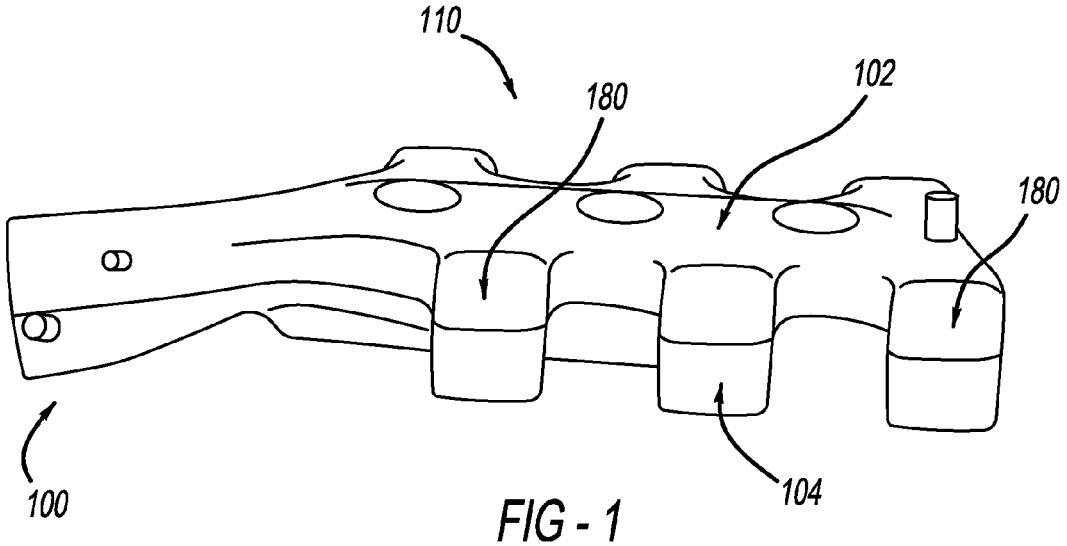
FIG. 1 illustratively depicts a perspective view of an inlet manifold according to one or more embodiments of the present invention.

As referenced in the figures, the same reference numerals may be used to refer to the same parameters and components or their similar modifications and alternatives. These specific parameters and components are included as examples and are not meant to be limiting. The drawings referenced herein are schematic and associated views thereof are not necessarily drawn to scale.

The present invention in one or more embodiments is believed to be advantageous in reflecting the understanding that unwanted water may accumulate inside of an inlet manifold and removal of such water may be hampered due to various reasons, one of which being the formation of an oil film or layer covering the water and hence resulting in a reduction of water evaporation. Water accumulation may be particularly profound in cold weather days, when ice gets built up in the intake manifold, and the ice then changes to water at rising temperatures, such as during a so-called "hot soak" period.

Accordingly and as detailed herein elsewhere, relatively more effective water evaporation and hence water removal may be effectuated via the employment of one or more straws implemented inside of the inlet manifold. Such straws may be positioned to beneficially facilitate water evaporation and water removal against the presence of the oil film or layer.

As illustratively depicted in FIG. 1 through FIG. 4A, the present invention in one or more embodiments provides an inlet manifold generally shown at 100. The inlet manifold 100 includes a plenum or plenum chamber 110, which in turn includes a plenum floor 104 and a plenum cover 102 positioned next to the plenum floor 104, and at least one straw 310 supported on and extending from the plenum floor 104 toward the plenum cover 102 to lead water transportation and removal. In certain embodiments, the inlet manifold 100 may include one or more of the runners 180.

Figure 3:
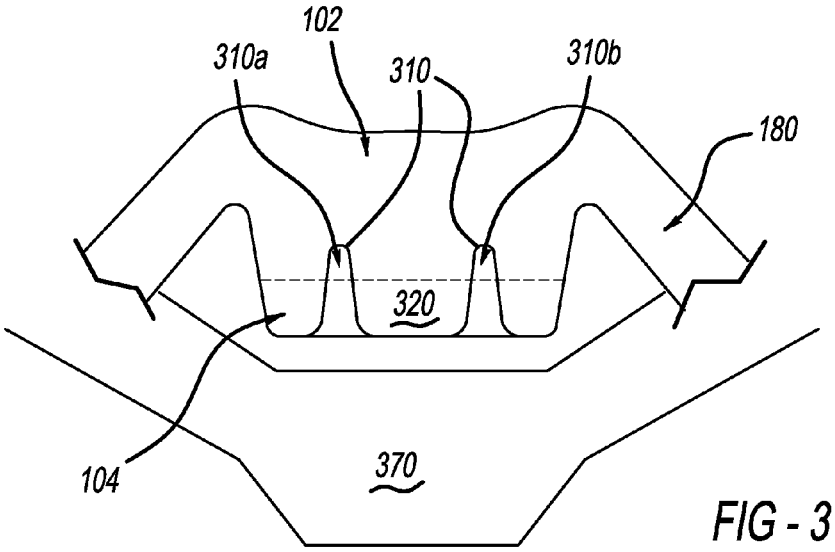
FIG. 3 illustratively depicts a cross-sectional view of the inlet manifold referenced in FIG. 1, positioned in relation to an engine block.
Figure 4A:
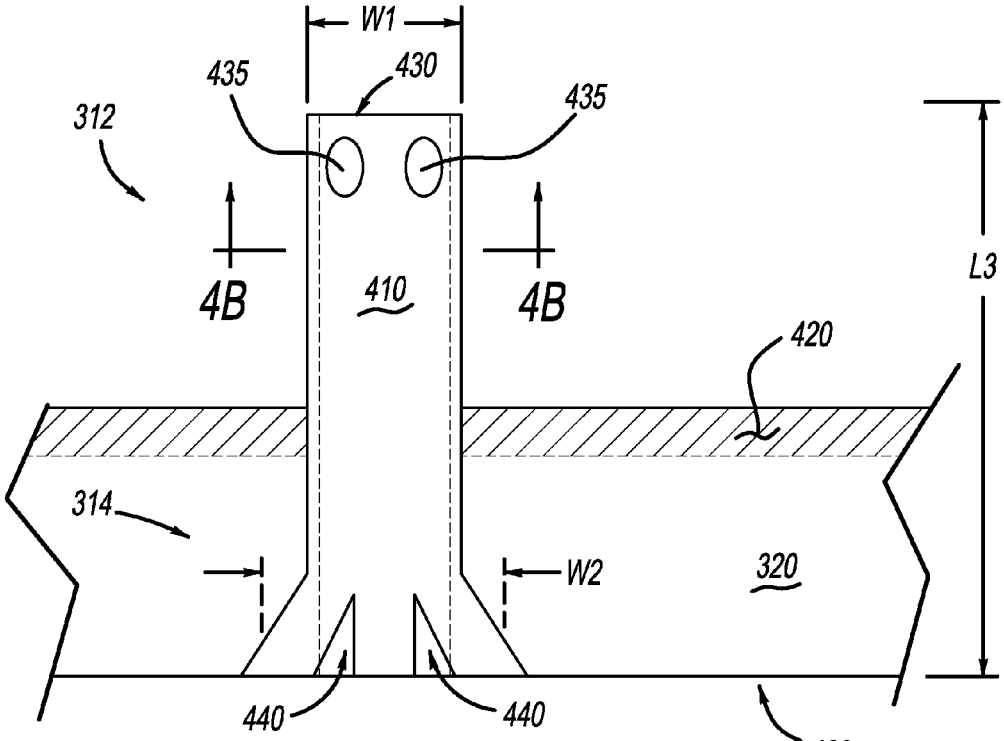
FIG. 4A illustratively depicts a partial, enlarged view of the inlet manifold referenced in FIG. 3.
Figure 4B:
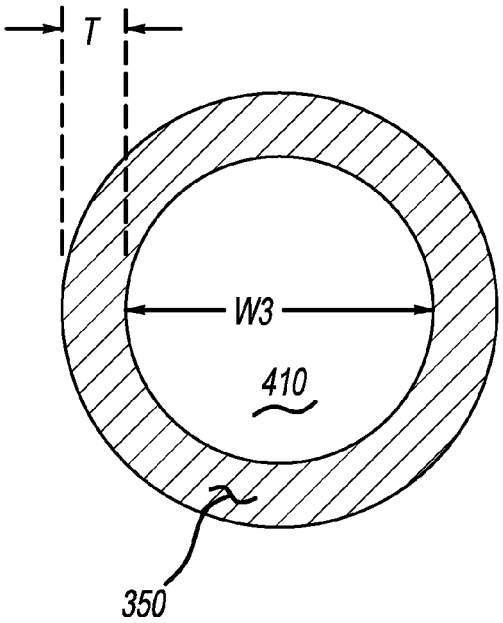
FIG. 4B illustratively depicts another partial, enlarged view of the inlet manifold referenced in FIG. 3.
Figure 4C:
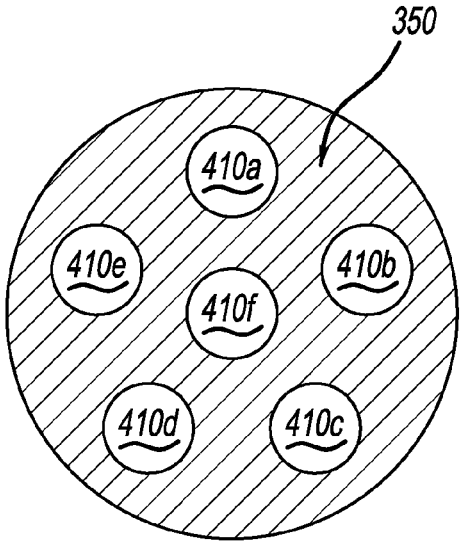
FIG. 4C illustratively depicts another partial, enlarged view of the inlet manifold referenced in FIG. 3.

With further reference to FIG. 3 and FIG. 4A, the at least one straw 310 may be configured so as to extend above or beyond an oil film or oil layer 420 that otherwise is inevitably to reduce water evaporation from a water body 320 underneath the oil layer 420. In this configuration, water from the water body 320 may travel via the at least one straw 310, while bypassing the interfering oil layer 420, and exit for evaporation and removal out of and above the oil layer 420.

In certain embodiments, and as illustratively depicted in FIG. 4A, the at least one straw 310 includes a main channel 410 extending along a longitudinal direction L from the plenum floor 104 toward the plenum cover 102. A cross-section taken along line 4B-4B is illustratively depicted in FIG. 4B and defines a side wall 350 enclosing therein a void space corresponding to the main channel 410. A cross-section width W3 of the main channel 410 may be of any suitable value relative to a cross-sectional thickness T of the side wall 350. In certain embodiments, the ratio of W3 relative to T is no less than 1. The main channel 410 functions as a main conduit for transporting water from the water body 320 for removal out of and above the oil layer 420. However, and in certain embodiments and as illustratively depicted in FIG. 4C, the main channel 410 may be configured to include a number of channels, such as channels 410*a*, 410*b*, 410*c*, 410*d*, 410*e* and 410*f*, spaced apart from each other and distributed strategically across a cross-section of the at least one straw 310. In this configuration, each of the channels 410*a* through 410*f* may be configured to have relatively small cross-section area to length ratios, which are believed to provide desirable capillary effects in leading water through the channels.

The size and dimension of the at least one straw 310 may each be independently varied dependent upon the distribution, location and/or depth of the water body 320. Accordingly, the present invention in one or more embodiments further provides versatility in the design of the inlet manifold 100 to accommodate operational conditions where presence of water may vary.

Figure 2:
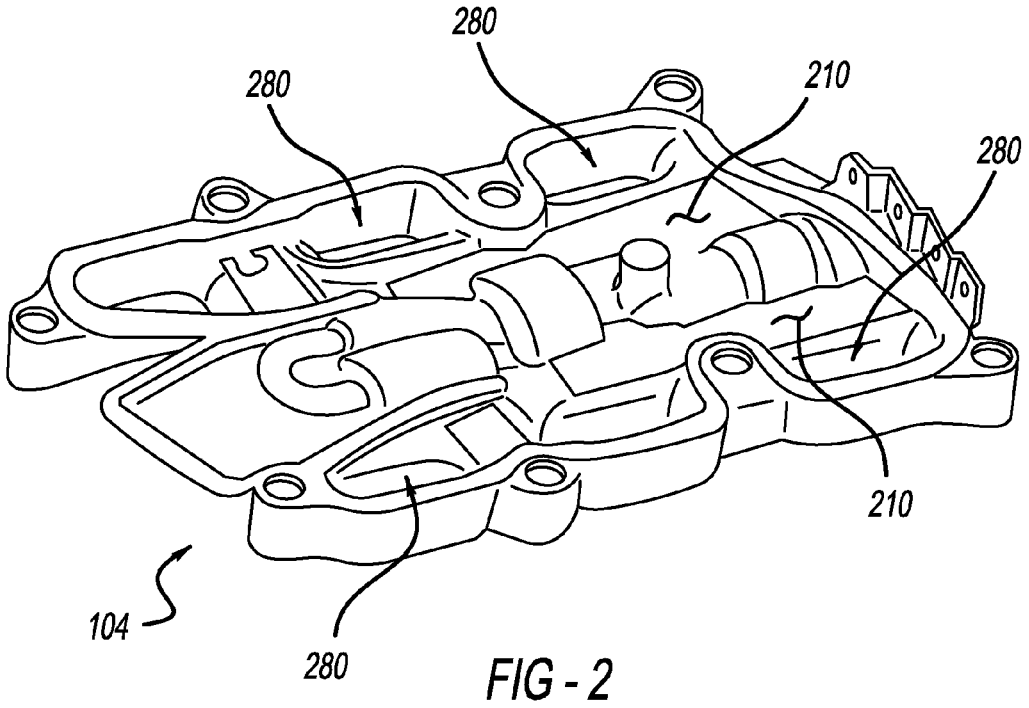
FIG. 2 illustratively depicts a partial perspective view of the inlet manifold referenced in FIG. 1.

For instance, and as illustratively depicted in FIG. 2, the plenum floor 104 of the inlet manifold 100 may be configured to include one or more cavities 210, which function to collect water as water is formed and accumulates. Compared to the nearby raised structures, the cavities 210 are strategically positioned to collect water, and the presence of the at least one straw 310 at or near the cavities 210 is believed to be particularly advantageous in removing the water as it becomes excessive and unwanted. This configuration is believed, as mentioned herein elsewhere, to enhance water removal and hence to reduce water entry into a nearby engine block 370 via runners 180, and accordingly to reduce engine malfunction including engine misfire due to the unwanted water entry.

Referring back to FIG. 1 and FIG. 3, the plenum 110 of the inlet manifold 100 is illustratively depicted to include the plenum cover 102 and the plenum floor 104 as two separable parts. However, and in certain embodiments, plenum cover 102 and the plenum floor 104 may be integrally formed as a single piece or component. Additionally, plenum cover 102 and the plenum floor 104 may be of any suitable shape, configuration and dimension, and of any suitable material.

The water-transporting straws described herein according to one or more embodiments, such as the straws 310 illustratively depicted in FIG. 3, may be readily employed to remove water in situations where no interference due to presence of oil layer or film may be present. In these scenarios, certain design parameters such as location of water exiting apertures relative to its corresponding water entry apertures may be relaxed.

Referring back to FIG. 2, the at least one straw 310 may be positioned at or near each of the cavities 210. Due to their proximity to various entry openings 280 of the runners 180, the presence of the at least one straw 310 relative to the cavities 210 is believed to provide an efficient and on-the-spot water removal in guarding against water entry through the entry openings 280.

As illustratively depicted in FIG. 3, the at least one straw 310 may include first and second straws 310*a*, 310*b* spaced apart from each other, which may be positioned within a single cavity 210 or two differently positioned cavities 210. In certain embodiments, the at least one straw 310 may be configured to include a number of individual straws distributed across the plenum floor 104 to facilitate water removal for a relatively greater area coverage.

Figure 5:
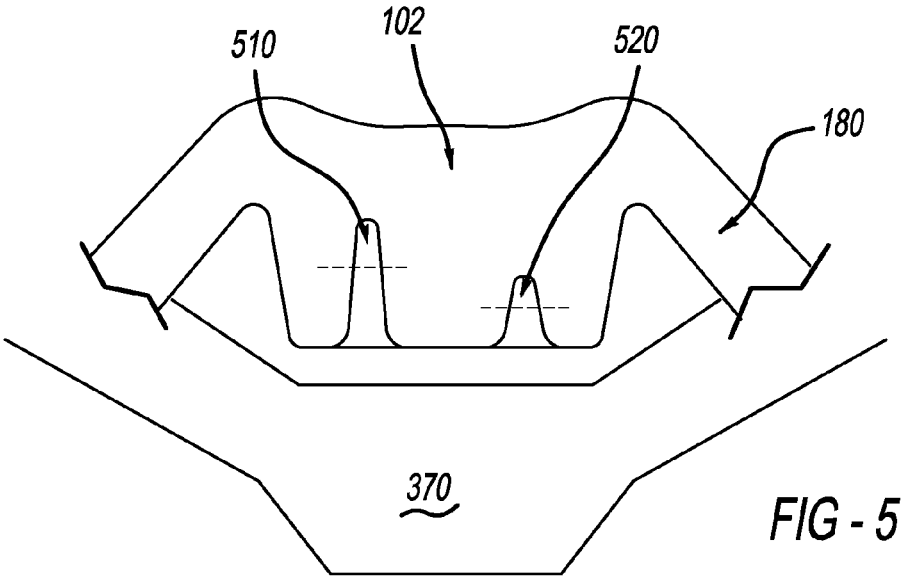
FIG. 5 illustratively depicts an alternative view of the inlet manifold referenced in FIG. 3.

The at least one straw 310 may further be varied in size, dimension, and structure material. In certain embodiments, and as illustratively depicted in FIG. 5, the at least one straw 310 may include first and second straws 510, 520 differing from each other in at least one of cross-sectional area and longitudinal length along the longitudinal direction L. This configuration may be particularly useful and beneficial to accommodate water removal in areas where the depth of a water body may vary among locations and a covering oil film may also be different in film thickness.

Referring back to FIG. 4A, the at least one straw 310 may be presented with a height or length L3 relative to a floor surface 490 of the plenum floor 104, where L3 relative to W1 or W3 may be of any suitable ratios, with non-limiting examples thereof including a ratio in the range of 1.5 to 100, 2 to 50, 2.5 to 25. In certain instances, the cross-sectional width W1 or W3 may be kept at a relatively small value, such as a ratio of smaller than 1/10 relative to L3, to facilitate water transport via capillary effects.

As mentioned herein elsewhere, the at least one straw 310 extends from the plenum floor 104 toward the plenum cover 102, and the extension may take a general direction along the longitudinal direction L. However, the at least one straw 310 itself does not necessarily have to be straight and may include turns and twists that are purposeful or incidental.

The at least one straw 310 may be formed of a material particularly suitable for the operational conditions typical of an automobile inlet manifold, while being a good medium for facilitating water transport and resistant to oil penetration. For instance, the at least one straw 310 may be formed of a metal, such as a steel material in any suitable grade. In certain embodiments, the at least one straw 310 may be formed integral to the plenum floor 104 via any suitable methods such as molding. In certain other embodiments, the at least one straw 310 may be pre-formed and thereafter attached to the plenum floor 104 via other suitable methods such as welding, fasteners and adhesives.

Referring back to FIG. 3 and FIG. 4A, the at least one straw 310 includes a top portion 312 to be positioned above the oil layer 420 and a bottom portion 314 to be positioned at or below the oil layer 420. The configuration is to allow exit of water vapor out of the oil layer 420 from the water body 320. As mentioned herein elsewhere, one or more apertures in any suitable shape and configuration may be positioned on the top portion 312 to facilitate the water removal.

In certain embodiments, and as illustratively depicted in FIG. 4A, the bottom portion 314 may be provided with a cross-sectional dimension "W2" that is greater than a cross-sectional dimension "W1" of the top portion 312. Without wanting to be limited to any particular theory, this configuration is believed to be beneficial in imparting structural stability to the at least one straw 310 relative to the plenum floor 104, and in providing additional design flexibility in water removal. For instance, one or more apertures 440 may form on the bottom portion 314 of the at least one straw 310 where a water-contacting surface 404 of the plenum floor 104 defines or is part of the boundary that defines the one or more of the apertures 440.

With further reference to FIG. 4A, the at least one straw 310 includes one or more first apertures 435 positioned on the top portion 312 to allow for water exit at a location out and above the oil layer 420. In the event that the main channel 410 opens out toward the plenum cover 102, the first aperture 435 may be positioned on a side wall 350 of the at least one straw 310 and be open and connected to the main channel 410 to lead additional water removal from the main channel 410 out through the side wall 350. In the event that the main channel 410 does not open out toward the plenum cover 102, for instance when the top portion 312 is connected to the plenum cover 102, the one or more first apertures 435 are the main water exit.

Referring back to FIG. 4A, one or more second apertures 440 may be positioned at the bottom portion 314 of the at least one straw 310 to facilitate water intake from the water body 320. The one or more second apertures 440 are open to the main channel 410 such that water may travel through the main chancel 410 along direction L upon entry through the one or more second apertures 440.

Figure 6:
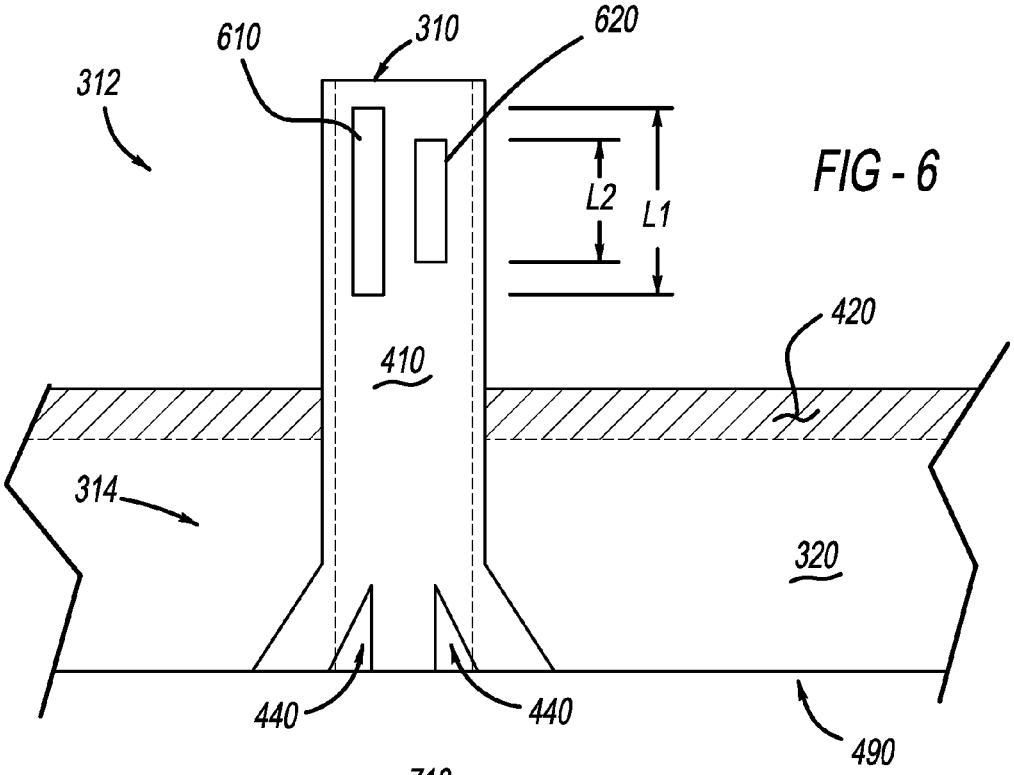
FIG. 6 illustratively depicts an alternative view of the inlet manifold referenced in FIG. 4A.

With further reference to FIG. 6, first and second elongated apertures 610, 620 may be formed on a side wall of the top portion 312 of the at least one straw 310. The first and second elongated apertures 610, 620 may be spaced apart from each other, while each extending along the longitudinal direction "L" with length L1 and L2, respectively. The length L1 may be different than the length L2 to accommodate for variations in water depth and operating temperatures at specific locations on the plenum floor 104.

Figure 7:
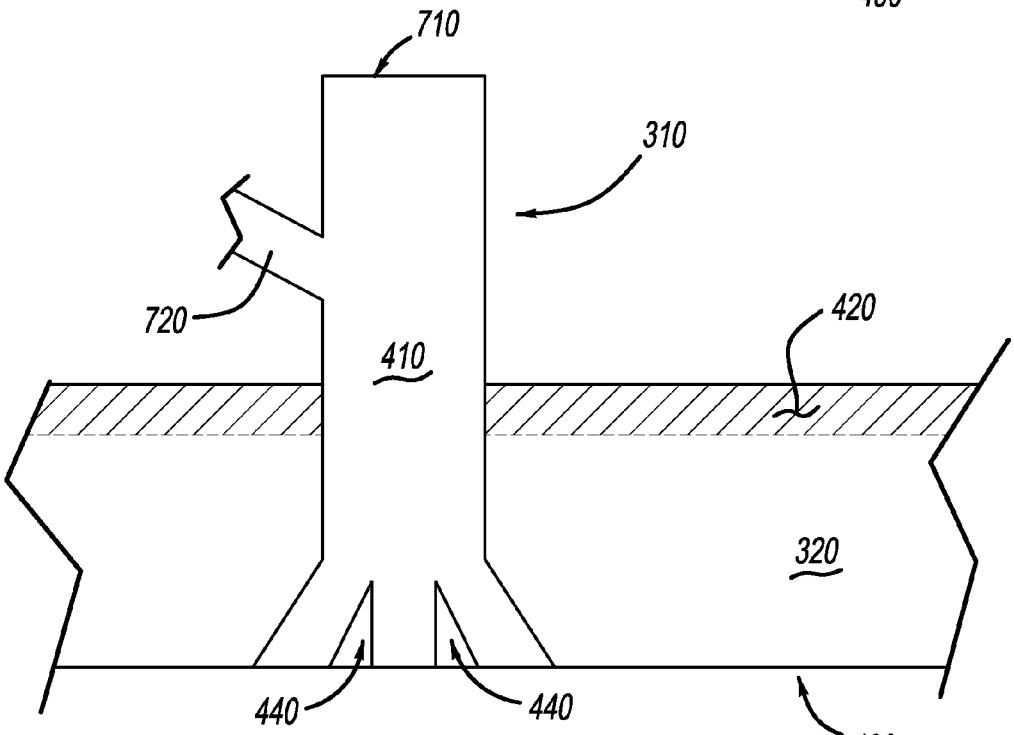
FIG. 7 illustratively depicts another alternative view of the inlet manifold referenced in FIG. 4A.

In certain embodiments, and as illustratively depicted in FIG. 7, the at least one straw 310 may be configured to include a trunk 710 and a branch 720 extending from the trunk 710. In this configuration, the branch 720 is open for water to exit at a location out of and above the oil layer 420. More than one branch may be positioned and extend from the trunk 710 for added water storage.

In one or more embodiments, the present invention as set forth herein is believed to have overcome certain challenges associated with excess water accumulation in an inlet manifold. One skilled in the art will readily recognize from such discussion, and from the accompanying drawings and claims that various changes, modifications and variations can be made therein without departing from the true spirit and fair scope of the invention as defined by the following claims.

What is claimed is:

1. An inlet manifold, comprising:

a plenum including a plenum floor and a plenum cover positioned next to the plenum floor; and at least one straw supported on and extending from the plenum floor toward the plenum cover to transport water, wherein the at least one straw includes first and second straws spaced apart from each other, the first straw differing than the second straw in at least one of cross-sectional area and extending length.

2. An inlet manifold, comprising:

a plenum including a plenum floor and a plenum cover positioned next to the plenum floor; and at least one straw supported on and extending from the plenum floor toward the plenum cover, wherein the at least one straw includes a first aperture to output water and a second aperture to intake water, the second aperture being positioned between the first aperture and the plenum floor, wherein the at least one straw includes first and second straws spaced apart from each other, the first straw differing than the second straw in at least one of cross-sectional area and extending length.

3. An inlet manifold, comprising:

a plenum including a plenum floor and a plenum cover, the plenum floor being positioned next to the plenum cover and including a cavity; and at least one straw integral to and extending from the cavity of the plenum floor toward the plenum cover, wherein the at least one straw includes a first aperture to output water and a second aperture to intake water, the second aperture being positioned between the first aperture and the plenum floor, wherein the at least one straw includes first and second straws spaced apart from each other, the first straw differing than the second straw in at least one of cross-sectional area and extending length.

* * * * *